US010538353B2

(12) United States Patent
Terenzi et al.

(10) Patent No.: US 10,538,353 B2
(45) Date of Patent: Jan. 21, 2020

(54) GRIPPING APPARATUS FOR A WRAPPING MACHINE

(71) Applicant: ROBOPAC S.P.A., Acquaviva-Gualdicciolo (SM)

(72) Inventors: Michele Terenzi, Fiorentino (SM); Pierangelo Laghi, Ravenna (IT)

(73) Assignee: ROBOPAC S.P.A., Acquaviva-Gualdicciolo (SM)

( * ) Notice: Subject to any disclaimer, the term of this patent is extended or adjusted under 35 U.S.C. 154(b) by 498 days.

(21) Appl. No.: 15/307,946

(22) PCT Filed: Apr. 30, 2015

(86) PCT No.: PCT/IB2015/053148
§ 371 (c)(1),
(2) Date: Oct. 31, 2016

(87) PCT Pub. No.: WO2015/166445
PCT Pub. Date: Nov. 5, 2015

(65) Prior Publication Data

US 2017/0057677 A1 Mar. 2, 2017

(30) Foreign Application Priority Data

May 2, 2014 (IT) ..... BO2014A0254

(51) Int. Cl.
*B65B 45/00* (2006.01)
*B65B 11/04* (2006.01)

(52) U.S. Cl.
CPC ..... *B65B 45/00* (2013.01); *B65B 11/045* (2013.01)

(58) Field of Classification Search
CPC ..... B65B 45/00; B65B 11/025; B65B 11/045; B65B 51/10; F16B 2/02; F16B 5/0048;
(Continued)

(56) References Cited

U.S. PATENT DOCUMENTS 2,630,751 A * 3/1953 Cranston ..... B65B 13/12 100/27
3,198,312 A * 8/1965 Loveland ..... A23N 4/14 198/385

(Continued)

FOREIGN PATENT DOCUMENTS

EP 1 714 876 10/2006
EP 2 208 675 7/2010

(Continued)

OTHER PUBLICATIONS

International Search Report dated Jul. 16, 2015 in International (PCT) Application No. PCT/IB2015/053148.

*Primary Examiner* — Nathaniel C Chukwurah
*Assistant Examiner* — Lucas E. A. Palmer
(74) *Attorney, Agent, or Firm* — Wenderoth, Lind & Ponack, L.L.P.

(57) ABSTRACT

A gripping apparatus associable to a wrapping machine and arranged to grip and retain an end flap of a film wrapped around a load at the end of a wrapping process, comprises pliers which include a first lever and a second lever that are hinged around a first axis and provided respectively with a first jaw and a second jaw suitable to tighten the film in a gripping position, a supporting arrangement for supporting the pliers and an actuator device fixed to the supporting arrangement and arranged to move the pliers between the gripping position and a releasing position, in which the jaws are spaced apart; the first lever comprises a first connecting end that is opposite to the first jaw and rotatably fixed to the supporting arrangement and the second lever comprises a second connecting end that is opposite to the second jaw, rotatably connected to the actuator device and linearly actuated by the latter along a first displacement direction in such a manner that the jaws are mobile around the first axis,
(Continued)

along said first displacement direction and along a second displacement direction transversal to said first displacement direction.

10 Claims, 5 Drawing Sheets

(58) Field of Classification Search
CPC ..... F16B 5/0068; F16B 2200/40; F16B 2200/509
See application file for complete search history.

(56) References Cited

U.S. PATENT DOCUMENTS 3,985,223 A * 10/1976 Forcella ..... B65G 47/842 198/377.03
4,077,179 A * 3/1978 Lancaster ..... B65B 11/045 100/15
4,216,640 A * 8/1980 Kaufman ..... B65B 11/045 53/556
4,432,185 A * 2/1984 Geisinger ..... B65B 11/045 53/138.2
4,545,182 A * 10/1985 McDowell, Jr. ..... B65B 13/10 53/556
4,619,102 A * 10/1986 Geisinger ..... B65B 11/045 53/399
4,993,209 A * 2/1991 Haloila ..... B29C 65/7471 53/373.9
5,088,270 A * 2/1992 Diehl ..... B65B 11/025 53/399
5,138,818 A * 8/1992 Humphrey ..... B65B 11/045 53/211
5,168,691 A * 12/1992 Errani ..... B65B 11/045 53/211
5,187,916 A * 2/1993 Errani ..... B65B 11/04 294/116
5,447,009 A * 9/1995 Oleksy ..... B65B 11/045 53/375.9
5,941,049 A * 8/1999 Lancaster ..... B65B 11/045 53/399
6,164,047 A * 12/2000 Rossi ..... B65B 11/045 53/556
6,170,233 B1 * 1/2001 Marois ..... B65B 11/025 53/399
6,185,900 B1 * 2/2001 Martin ..... B65B 11/045 53/118
6,269,610 B1 * 8/2001 Lancaster, III ..... B65B 11/045 53/399
6,360,512 B1 * 3/2002 Marois ..... B65B 11/006 53/399
6,684,612 B2 * 2/2004 Trottet ..... B65B 11/045 53/556
6,761,017 B1 * 7/2004 Rossi ..... B65B 11/045 53/211
8,695,312 B2 * 4/2014 Johnson ..... B65B 11/025 269/32
9,511,886 B2 * 12/2016 Liu ..... B65B 61/10
9,625,083 B2 * 4/2017 Cere' ..... B65B 11/025
9,688,428 B2 * 6/2017 Liu ..... B65B 61/10
2002/0162436 A1 * 11/2002 Marois ..... B65B 11/025 83/13
2003/0093974 A1 * 5/2003 Rossi ..... B65B 11/045 53/399
2003/0140599 A1 * 7/2003 Forrest ..... B65B 11/045 53/399
2004/0088954 A1 5/2004 Cousins et al.
2004/0177592 A1 * 9/2004 Lancaster, III ..... B65B 11/045 53/399
2004/0240975 A1 12/2004 Baraggioli
2007/0289262 A1 * 12/2007 Koehn ..... B65B 1/02 53/570
2009/0288534 A1 * 11/2009 McCoy ..... B26F 3/08 83/171
2012/0079929 A1 * 4/2012 Ciou ..... B26D 5/16 83/375
2013/0312366 A1 * 11/2013 Ciou ..... B65B 11/045 53/203
2015/0000438 A1 * 1/2015 Abel ..... B65B 43/32 74/105
2015/0151861 A1 * 6/2015 Chalmers ..... B65D 19/00 53/556
2017/0361955 A1 * 12/2017 Luo ..... B65B 61/06

FOREIGN PATENT DOCUMENTS

EP 2 657 139 10/2013
WO 2014/005181 1/2014

* cited by examiner

GRIPPING APPARATUS FOR A WRAPPING MACHINE

The invention relates to machines for wrapping a load with stretchable plastic material film. In particular, the invention relates to a gripping apparatus arranged to grip and retain a film portion at the end of the load wrapping process.

In known wrapping machines the plastic material film, typically a cold stretchable plastic material film, is unwound from a reel supported by an unwinding apparatus and is wrapped around a load, generally arranged on a pallet, in such a manner as to form a series of braided and/or overlapped strips or coils, thanks to the combination of a movement in the vertical direction of the unwinding apparatus and the relative rotation between the latter and the load.

In wrapping machines provided with a rotating table for supporting the load, the load is rotated around a vertical wrapping axis, while the unwinding apparatus is vertically moved with alternate motion.

In wrapping machines with horizontal ring or rotating arm, the load is fixed during the wrapping, while the unwinding apparatus is moved with respect to the load both in rotation around the vertical wrapping axis and in translation along the latter.

The unwinding apparatus supports the film reel and comprises a couple of pre-stretching rollers arranged to unwind the film from the reel and stretch or extend it and one or more return rollers arranged to divert the film toward the load. By suitably adjusting the difference between the rotation speeds of the pre-stretching rollers, it is possible to stretch the film exiting from the unwinding apparatus by a defined amount.

At the end of wrapping process, namely when the load has been wrapped with a prescribed number of braided film strips, the relative rotation between the unwinding apparatus and the load is stopped for fixing an end flap of the film to the load and thus fastening the wrapping. For performing this operation, gripping apparatuses are generally used which allow to grip and retain the film at a region comprised between the unwinding apparatus and the load and welding and cutting apparatuses that allow fixing and separating an end flap of the film to the load. More precisely, a portion of film coming from the reel is pressed by a welding element against the film that is wrapped around the load. The portion of film that is welded on the wrapped film blocks the film wrapping around the load.

After welding, the film is cut in such a manner as to carry out a first end flap, which is welded and fixed to the load, and a second end flap, which is connected to the reel and retained by the gripping apparatus for allowing the wrapping of a following load. The gripping apparatus releases the film once the wrapping of the following load is started, typically after at least one wrapping round. The film end flap thus can be wrapped around the load by the film itself.

The gripping apparatus and the welding and cutting apparatus are generally placed on the rotating table or beside and adjacent to the latter or to the supporting and moving means of the load for allowing fixing the film not only to the load but also to a pallet, on which the load is placed.

The gripping apparatus typically comprises pliers provided with two mobile and opposite jaws or beaks that are able to grip and retain the film and then to release the latter when the wrapping is started. The pliers are arranged vertically. In the open position both jaws are spaced apart for releasing the film and for allowing the film to be wrapped around the load, while in the closed position the jaws are in abutment so as to grip and retain the film.

A drawback of the known gripping apparatuses consists in the pliers size, in particular the jaws size, which must be such as to allow a correct and tight grip of the film in the closed position and a free wrapping of the film around the load in the open position. The two requirements are, however, opposed. The jaws in fact have to be long enough to allow to grip and retain a portion of film suitably long to avoid, during wrapping, that said portion may tear, with the consequent detachment of the film end flap, as a result of the tension stresses acting on the film itself. At the same time, the jaws have to be short enough in order not to limit and prevent the wrapping by interfering with the film, in particular with the wrapping of the lower portions of the film and underlying pallet.

To overcome this drawback pliers are generally interchangeable, replaceable according to the size of the load and/or the strip width of the film (typically between 125 mm and 500 mm).

This solution is however expensive and complex because it requires a set of gripping pliers having different sizes and replacement operations which require to stop the wrapping machine and thus the production.

Alternatively, in order to overcome such drawbacks there are known apparatuses that allow reducing the film width, substantially by corrugating and narrowing the end flap and the portion of film to be welded and retained. For this purpose, the welding and cutting apparatus or the unwinding apparatus comprises a gripping element (i.e. a spring) which grips and corrugates the film. However, this solution is expensive and complex.

Another drawback of the known gripping apparatuses is that, during the pliers opening in the release step, due to the relative rotation of the load with respect to the unwinding apparatus, the film may stick to, wrap to, and be caught on one of the pliers jaws, this causing a malfunction of said pliers in the subsequent step of the gripping of the film and/or an incorrect wrapping of the load, the end flap of the film being not properly wrapped around the load.

For overcoming this drawback, compressed air blowing systems are known and used in wrapping machines that comprise blowing nozzles arranged around the gripping apparatus and directed towards the end flap of film for avoiding that the film sticks to and is wrapped to the pliers. These pneumatic systems are, however, expensive and complex to install and use.

An object of the invention is to improve the known gripping apparatuses associable to a wrapping machine for gripping and retaining an end flap of a stretchable plastic material film at the end of a wrapping process of a load.

Another object is to carry out a gripping apparatus, which allows correctly and tightly gripping and retaining an end flap of a film regardless of the width thereof.

A further object is to provide a gripping apparatus, which does not interfere in any way with the wrapping of the load in a disengagement configuration.

Still another object is to carry out a gripping apparatus, which allows easily and correctly releasing the film in order to avoid possible undesired wrapping.

Another further object is to carry out a simple and inexpensive gripping apparatus having a precise, effective and reliable operation.

These objects and others are achieved by an apparatus according to one or more of the following claims.

The invention can be better understood and implemented with reference to the attached drawings which illustrate some exemplifying and not limitative embodiments, wherein.

Figure 1:
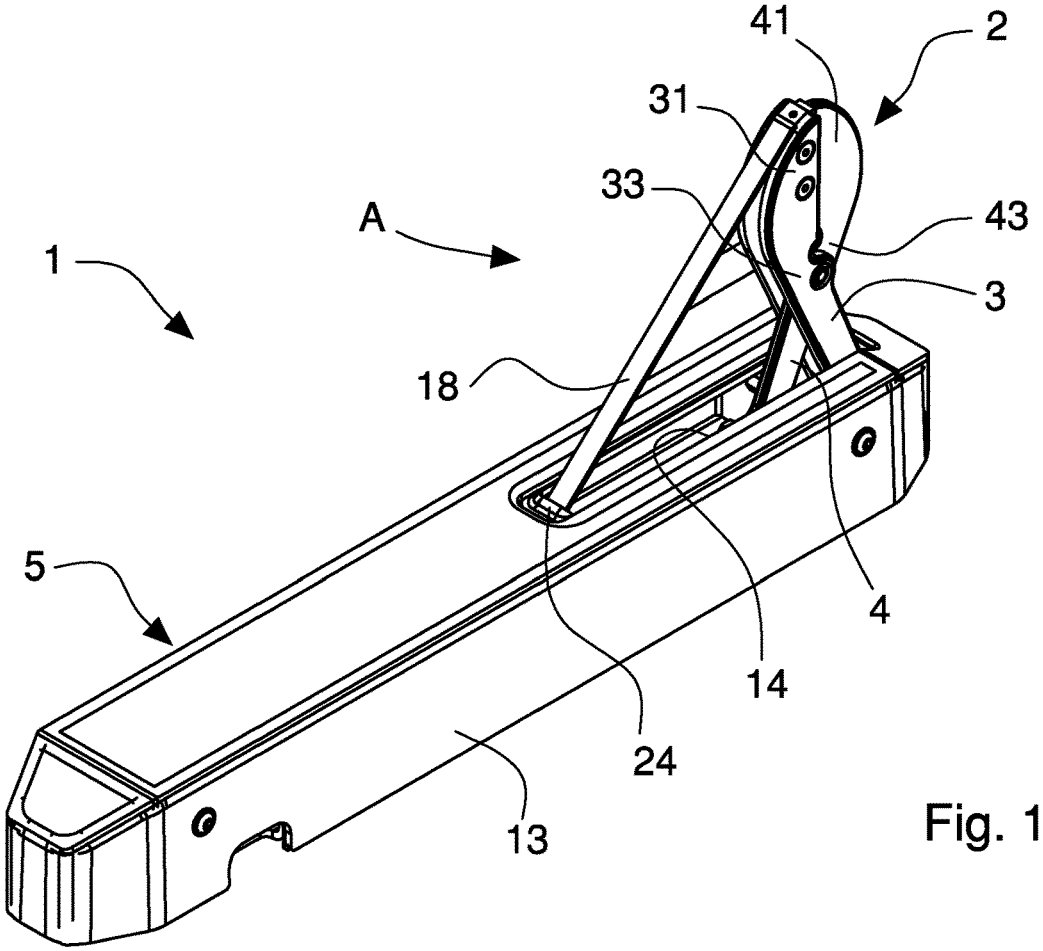
FIG. 1 is a perspective view of the gripping apparatus of the invention with pliers in a gripping position.
Figure 2:
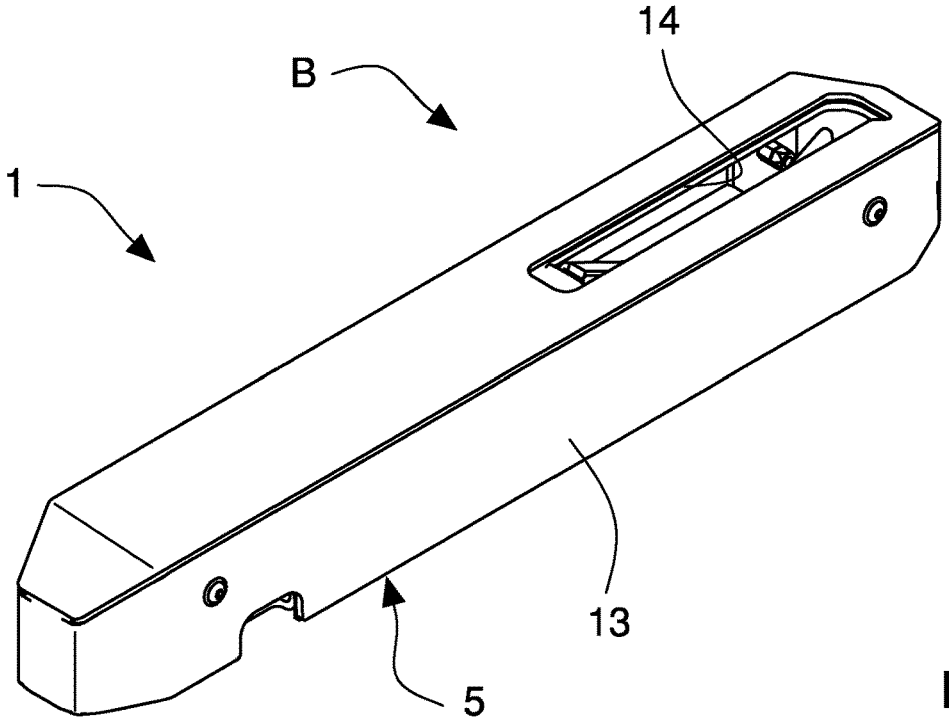
FIG. 2 is a perspective view of the gripping apparatus of the invention with pliers in a releasing position.
Figure 4:
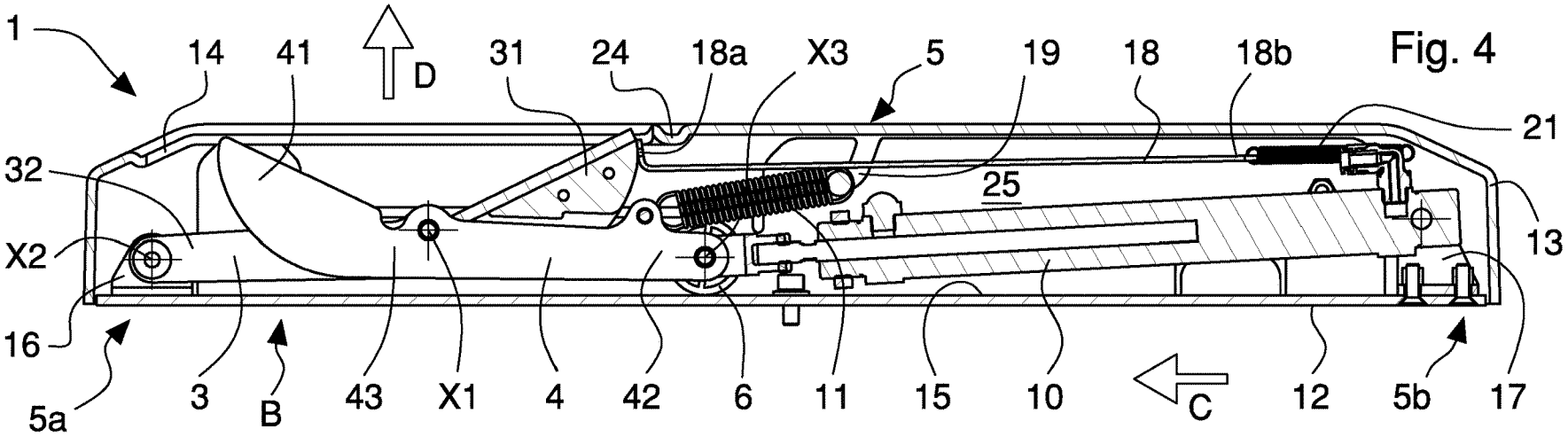
FIG. 4 is a longitudinal section of the apparatus of FIG. 2.

FIGS. 1 to 6 illustrate the gripping apparatus 1 of the invention associated to a wrapping machine 60, suitable to wrap a load 100 with a film 50 made in stretchable plastic material, and arranged to grip an end flap 50*a* of the said film 50 at the end of the wrapping process of the load 100.

The gripping apparatus 1 comprises pliers 2, a supporting arrangement 5 which supports the pliers 2 and an actuator device 10, 11 fixed to the supporting arrangement 5 and arranged to move the pliers 2 between a closed gripping position A and an open releasing position B of the film 50.

The pliers 2 comprise a first lever 3 and a second lever 4 that are mutually hinged around a first axis X1 and provided respectively with a first gripping jaw 31 and a second gripping jaw 41 that are arranged to tighten the film 50 in the gripping position A. In particular, the first lever 3 and the second lever 4 are mutually rotatably coupled around the first axis X1 at a first central portion 33 and a second central portion 43, respectively.

In the gripping position A the pliers 2 are closed, the jaws 31, 41 being in abutment for tightening and retaining the film 50. In the releasing position B, the pliers 2 are opened, the jaws 31, 41 being rotated and spaced apart for not releasing the film and not interacting with the latter, as better explained in the following description.

The first lever 3 comprises a first connecting end 32 that is opposed to the first jaw 31 and rotatably fixed to the supporting arrangement 5, while the second lever 4 comprises a second operating end 42 that is opposite to second jaw 41 and rotatably connected to the actuator device 10, 11. The second operating end 42 is linearly moved by the actuator device 10, 11 along a first displacement direction C in such a manner that the jaws 31, 41 of the levers 3, 4 of the pliers 2 are mobile with a composed motion around the first axis X1, along the first displacement direction C and along a second displacement direction D that is transversal, in particular substantially orthogonal, to the first displacement direction C.

The first connecting end 32 of the first lever 3 is fixed to the supporting arrangement 5 and rotatable around a second axis X2, which is nearly parallel to the first axis X1.

The second connecting end 42 of the second lever 4 is coupled to the actuator device 10 and rotatable about a third axis X3, which is almost parallel to the first axis X1.

The apparatus 1 also comprises a guiding element 6 that is associated with the second connecting end 42 of the second lever 4 and arranged for linearly guiding the second connecting end 42 along the first displacement direction C. More precisely, the guiding element comprises a roller 6, or wheel, rotatably fixed, around the third axis X3, to the second connecting end 42 and mobile on an abutting wall 15 of the supporting arrangement 5 so as to guide and support the second lever 4, both when moving between the releasing position B and the gripping position A and vice versa and in the gripping position A of the pliers 2. Alternatively, the guiding element 6 can comprise a sliding block fixed to the second connecting end 42 and slidably engaged with a linear guide that is fixed to the abutting wall 15 of the supporting arrangement 5.

The supporting arrangement 5 comprises a support frame 12 to which the pliers 2 and the actuator device 10, 11 are fixed and a box-shaped covering case 13, for example having the shape of an elongated parallelepiped, that is fixed in a removable manner to the support frame 12 so as to enclose the latter and define an inner cavity 25 that is arranged to house the actuator 10, 11 and the pliers 2, in the releasing position B. The covering case 13 is provided with an opening 14, which allows the levers 3, 4 coming out in the gripping position A.

In the embodiment shown in the figures, the actuator device comprises a linear actuator 10 arranged to move the second lever 3 and the first lever 2 between the releasing position B and the gripping position A. The linear actuator 10 is, for example, a pneumatic or hydraulic cylinder, or may comprise a linear electric motor or screw-nut system actuated by a rotating electric motor or other equivalent moving mechanisms. In the illustrated embodiment, the linear actuator 10 is a single acting cylinder and the actuator device also comprises an elastic arrangement 11 fixed to the supporting arrangement 5 and to the second connecting end 42 of the second lever 4 for moving the latter and the first lever 3 between the gripping position A and the releasing position B. The elastic arrangement 11 comprises, for example, a helical spring acting in traction, fixed at its respective ends to the second connecting end 42 of the second lever 4 and to a hooking element 19 positioned in the inner cavity 25.

Figure 3:
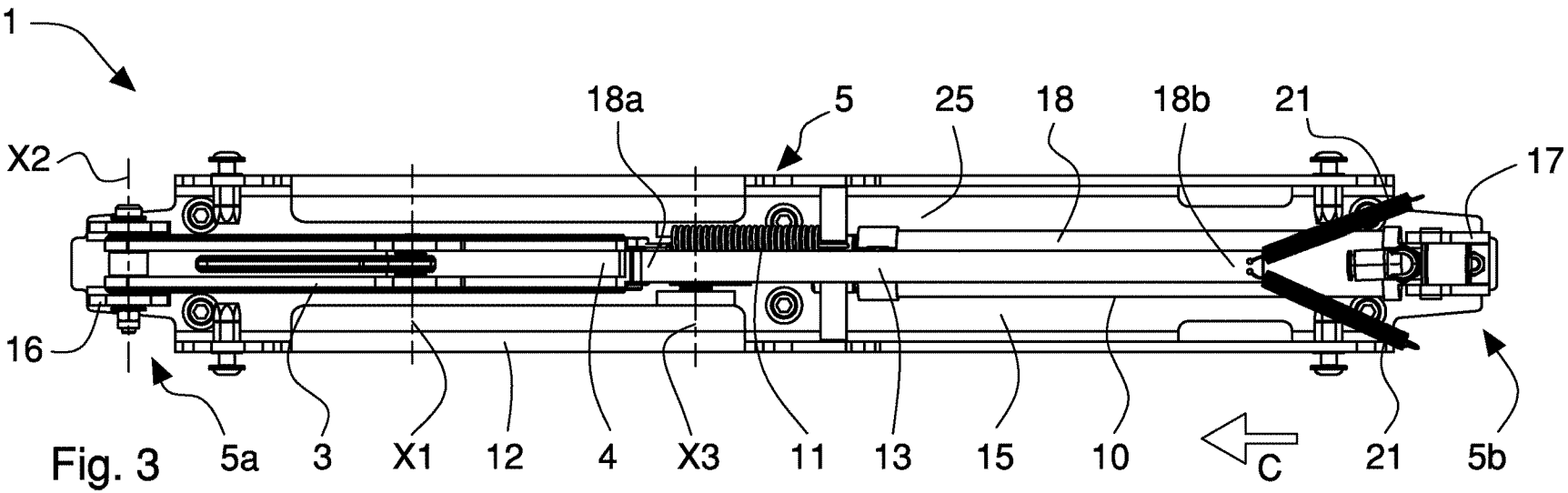
FIG. 3 is a plan view of the gripping apparatus of FIG. 1 without a covering case for better showing the pliers and the inner parts.
Figure 5:
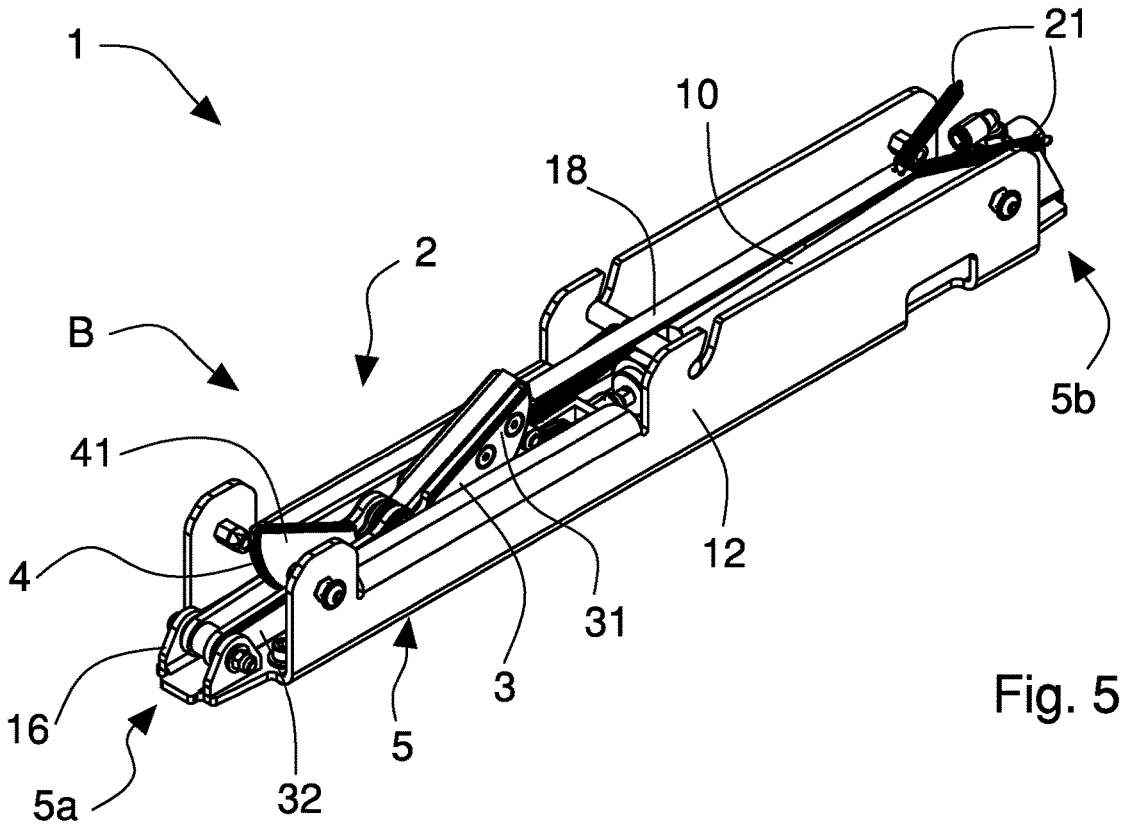
FIG. 5 is a perspective view of the apparatus of FIG. 2 without a covering case.
Figure 6:
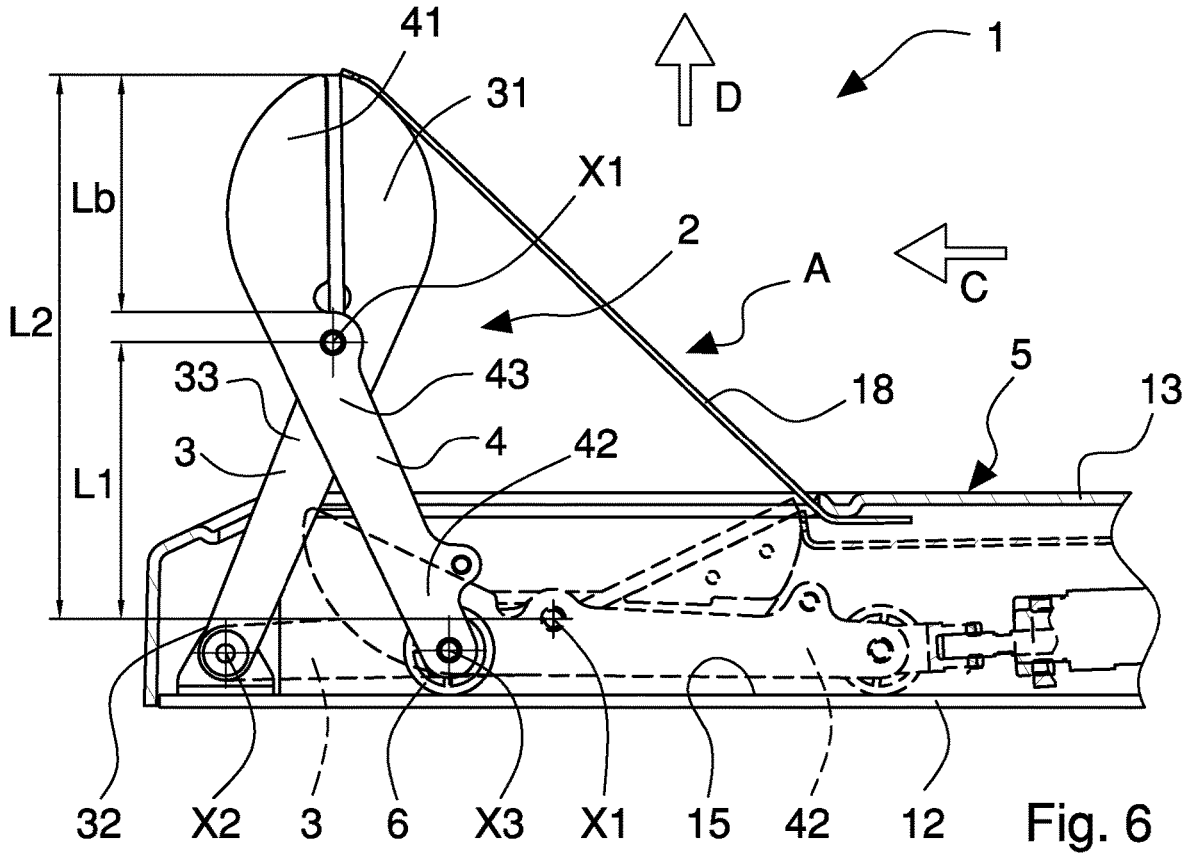
FIG. 6 is a partial and enlarged longitudinal section of the apparatus of the invention which illustrates the pliers arranged in the gripping position and, illustrated in dotted line, in the releasing position.

As particularly illustrated in FIGS. 3 and 5, the first lever 3 is hinged at the first connecting end 32 to a first bracket 16 of the supporting arrangement 5 that is positioned at the first end portion 5*a* of the latter. Similarly, an end of the linear actuator 10 is hinged to a second bracket 17 of the supporting arrangement 5 that is positioned at a second end portion 5*b* of the supporting arrangement 5 that is opposite to the first end portion 5*a*.

The opening 14 for allowing the pliers 2 coming out longitudinally extends parallel to the first direction of movement C, from the first end portion 5*a* of the supporting arrangement 5 and towards the second end portion 5*b*. The length of the opening 14 is such to allow the rotating and translating movement of the levers 3, 4 from the releasing position B to the gripping position A and vice versa.

The apparatus 1 also comprises a diverting element 18 fixed to one of the jaws 31 of the pliers 2 and to the supporting arrangement 5 so as to prevent the film 50, in particular the end portion 50*a* thereof, to stick to and/or wrap around the pliers 2 when the levers 3, 4 are moved from the gripping position A to the releasing position B for releasing said end flap 50*a*, in an initial step of a wrapping process of a load 100.

The diverting element comprises a flexible elongated element 18, such as a tape or belt made of plastic or metallic material, provided with a first end portion 18*a* fixed to the first jaw 31 of the first lever 3 and a second end portion 18*b* elastically fixed to the supporting arrangement 5. In particular, the second end portion 18*a* is fixed through a further elastic arrangement 21 to hooking elements that are positioned in the inner cavity 25. The further elastic arrangement 21 keeps taut and under tension the flexible element 18 which, in the gripping position of the pliers A, comes out from the opening 14 of the supporting arrangement 5, sliding on a guiding portion 24 of said supporting arrangement 5 that is carried out at the opening 14. The further elastic arrangement comprises, for example, a couple of helical springs 21 acting in traction, the ends thereof are fixed to the second end portion 18*b* of the flexible elongate element 18 and to respective hooks of the supporting arrangement 5 that are positioned at opposite side with respect to the levers 3, 4.

The flexible elongated element 18 in the gripping position A is substantially superimposed on the opening 14 thus preventing the end flap 50*a* to stick to and wrap around the levers 2, 3 and/or engage the opening 14.

Figure 7:
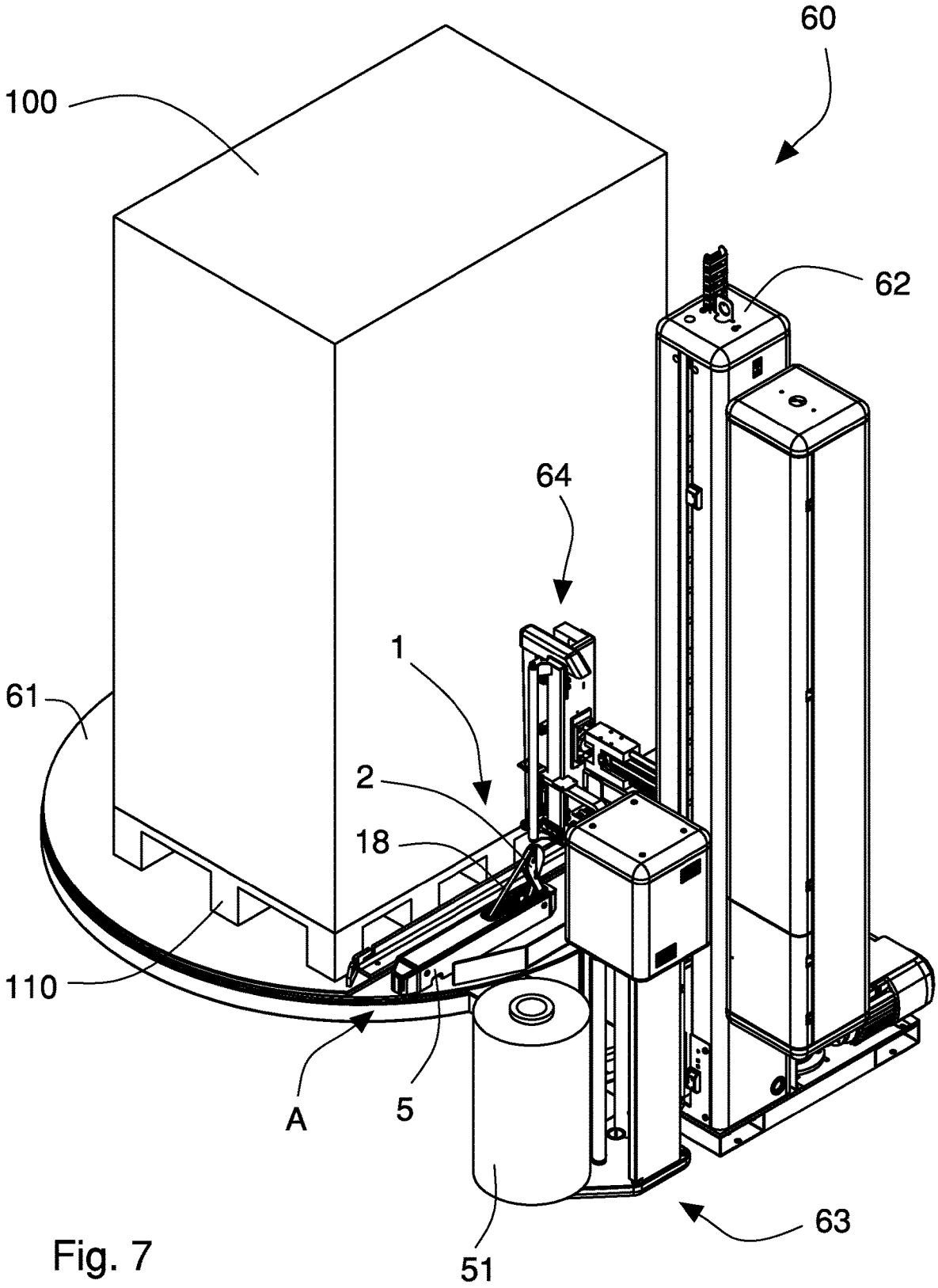
FIG. 7 is a perspective view of the gripping apparatus of the invention associated with a wrapping machine with rotating table and with the pliers in the closed gripping position.
Figure 8:
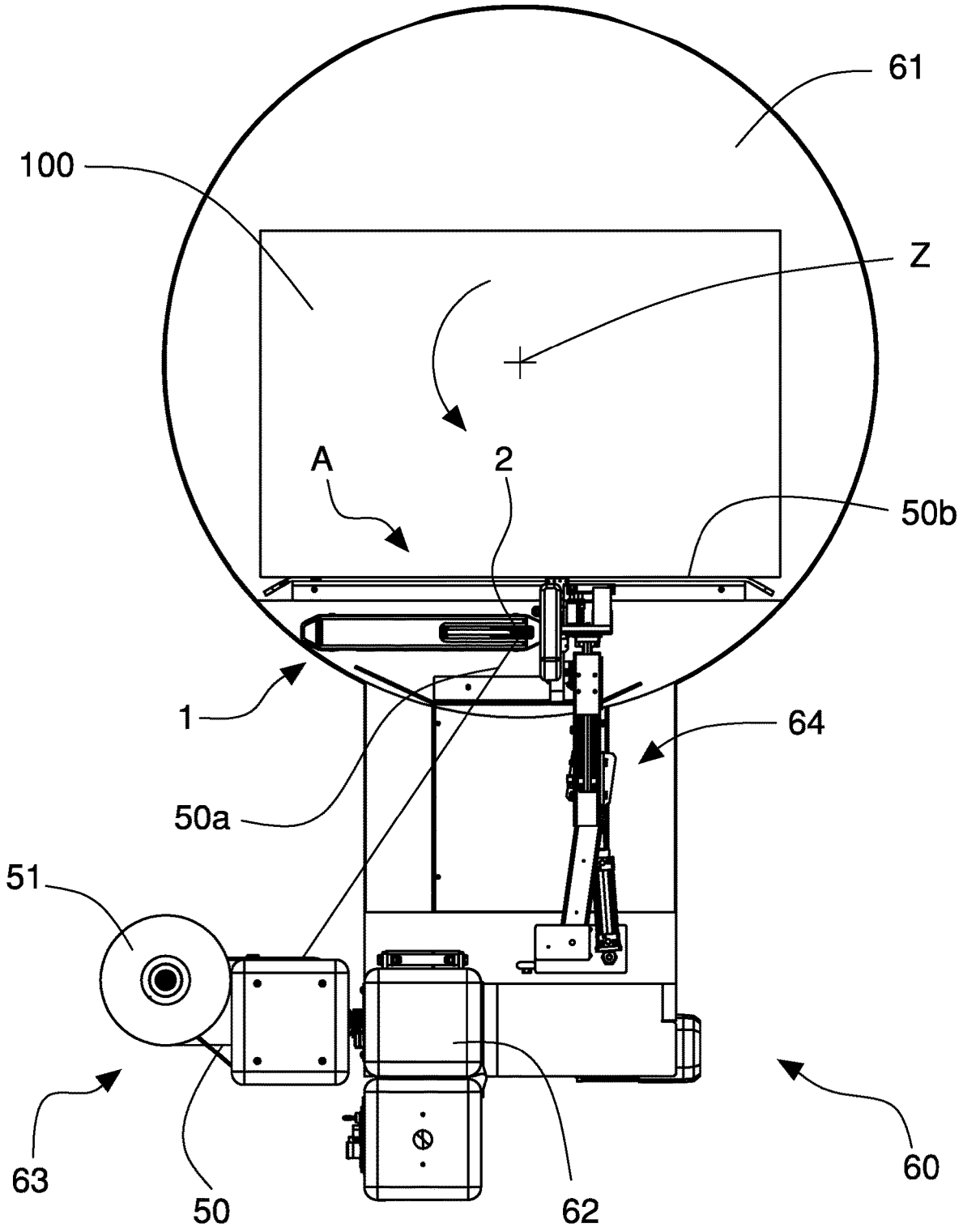
FIG. 8 is a top plan view of the apparatus and of the wrapping machine of FIG. 7.

As illustrated in FIGS. 7 and 8, the gripping apparatus 1 of the invention may be associated with a wrapping machine 60 arranged for wrapping a load 100 with the film 50. In the embodiment shown by way of non-limiting example, the wrapping machine 60 is a wrapping machine comprising a table or platform 61 that is rotatable around a vertical axis Z and arranged to support the load 100 to be wrapped. The machine 60 includes a column 62 that is positioned at the side of the rotating table 61 and slidably supports an unwinding apparatus 63 comprising a reel 51 from which the film 50 is unwound, and pre-stretching and return rollers which stretch or extend the film 50 before the wrapping and then to head the film outside towards the load 100.

The machine 60 is provided with a welding and cutting apparatus 64 of the film 50 that is arranged to fix the film 50 to the load 100 at the wrapping end and then cut the film so as to carry out two end flaps 50*a*, 50*b*, namely a first end flap 50*a* that is retained by the gripping apparatus 1 and a second end flap 50*b* that is fixed to the load 100.

For this wrapping machine type, the gripping apparatus 1 of the invention is fixed to the rotating table 61 at a peripheral edge thereof, so as to be adjacent to the load 100 and to a pallet 110 on which the load 100 is positioned.

The gripping apparatus 1 can be also associated to a wrapping machine with rotating arm or to a wrapping machine with horizontal rotating ring. In this case, the gripping apparatus 1 is static, typically connected to a supporting and moving system (roller conveyor) which supports and moves the load inside and outside the machine.

The operation of the gripping apparatus 1 of the invention is now described in relation to the operation of the wrapping machine 60.

In a terminal step of the wrapping process of the load 100, the cutting and welding apparatus 64 is approached to the load itself in order to fix the film 50 to the load and then to cut the latter so as to obtain two end flaps 50*a*, 50*b*. Before the cutting, the gripping apparatus 2 is actuated and the pliers 2 are moved by the actuator device 10, 11 with a closing movement from the releasing position B to the gripping position A. In the releasing position B the pliers 2 are substantially open and fully enclosed in the inner cavity 25 of the supporting arrangement 5 so as not to interfere with the previous wrapping of the film 50 around the load 100, the jaws 31, 41 being rotated and spaced apart each other.

In the gripping position A the pliers 2 come out from the inner cavity 25 of the supporting arrangement 5 through the opening 14 and are substantially closed so as to tighten and retain the film 50. The jaws 31, 41 abut each other and tighten the film 50, the levers 3, 4 are arranged in a substantially vertical position.

It should be noted that, thanks to the articulated connection of the levers 3, 4 that are connected to each other and to the supporting arrangement 5 and the actuator device 10, during the closing movement the levers 3, 4, and in particular the respective jaws 31, 41, move with a composed motion around the first axis X1, along the first displacement direction C and along a second displacement direction D that is orthogonal to the first displacement direction C. More precisely, the levers 3, 4 rotate relatively to each other around the first axis X1, which moves along the first displacement direction C and along the second displacement direction D that are orthogonal to each other. In this manner, the jaws 3, 4 are rotated by an angle so as to tighten the film 50 and are also moved upwards along the second displacement direction D by a distance L1 so as to grip, drag and fold a greater amount of film 50. More precisely, unlike the known pliers, the gripping apparatus 1 of the invention allows to grip, by corrugating or folding, a portion of film having a first length L2 much greater (more than twice) than a second length Lb of the jaws 31, 41.

Thanks to the gripping apparatus 1 of the invention it is therefore possible to grip and retain in a tight and safe manner films 50 having a bandwidth ranging from minimum values to maximum values, even with the apparatus 1 having particularly reduced and compact size and overall dimensions, particularly in height.

It should be noted, in fact, that in the releasing position B, the pliers 2 are opened and completely enclosed inside the inner cavity 25 of the supporting arrangement 5, having very small overall dimensions, which do not hinder or prevent the wrapping of a lower portion of the load 100 and/or the pallet 110.

Once the film 50 is gripped by the pliers 2 of the gripping apparatus 1, the cutting and welding apparatus 64 cuts the film 50 thus creating the two end flaps, one of which (the first end flap 50*a*) is tightened and retained by the pliers 2.

The load 100 that is correctly wrapped can be thus removed from the machine 60 in order to make way for a subsequent load 100 to be wrapped.

In the initial steps of the subsequent wrapping process, the load 100 is rotated so as to be wrapped with the film 50 and the pliers 2 in the gripping position A retains the first end flap 50*a*. When the load is partially wrapped with one or more bands of film 50, the pliers 2 can be moved in the releasing position B so as to release said first end flap 50*a* which can be completely wrapped by the film 50 on the load 100.

During the opening movement of the levers 3, 4 from the gripping position A to the releasing position B, the diverting element 18, comprising the flexible element that is connected to the first jaw 31 of the first lever 3, prevents that the first end flap 50*a*, once released, may stick to said first lever 3 and get caught on, or wrap around, said first lever 3, thus remaining detached from the wrapping of the load 100, or stopping the operation of the pliers 2 by entering into the inner cavity 25 through the opening 14.

It should be noted that the flexible element 18 is substantially superimposed on the opening 14 and kept in tension by further elastic arrangement 21 so as to be a sort of barrier that prevents the film 50, in particular the first end flap 50*a*, to engage the pliers 2 and/or the opening 14.

Thanks to the flexible element 18, the gripping apparatus 1 of the invention therefore allows to release easily and correctly the film 50 thus avoiding possible undesired wrappings thereof around the pliers 2.

The invention claimed is:

1. A gripping apparatus associable to a wrapping machine and for gripping and retaining an end flap of a film wrapped around a load at the end of a wrapping process, the gripping apparatus comprising:

pliers including a first lever and a second lever that are mutually rotatably coupled about a first axis and provided respectively with a first jaw and a second jaw configured to grip the film in a gripping position;

a supporting arrangement for supporting said pliers; and an actuator device fixed to said supporting arrangement and arranged for moving said pliers between the gripping position and a releasing position, in which said first and second jaws are spaced apart from each other, wherein said first lever comprises a first connecting end that is opposite to said first jaw, rotatably fixed to said supporting arrangement and rotatable about a second axis, said second lever comprises a second connecting end that is opposite to said second jaw, rotatably connected to said actuator device and linearly movable by said actuator device along a first displacement direction such that said first and second jaws are mobile about the first axis, which is mobile, along the first displacement direction and along a second displacement direction that is transverse to the first displacement direction.

2. The gripping apparatus according to claim 1, wherein said first connecting end is rotatable about the second axis, which is parallel to the first axis, and wherein said second connecting end is rotatable about a third axis that is parallel to the first axis.

3. The gripping apparatus according to claim 2, further comprising a guiding element associated with said second connecting end for guiding said second connecting end along the first displacement direction.

4. The gripping apparatus according to claim 3, wherein said guiding element comprises a roller that is fixed to said second connecting end, rotatable about the third axis and mobile on an abutment wall of said supporting arrangement.

5. The gripping apparatus according to claim 1, wherein said supporting arrangement comprises a supporting frame that said pliers and said actuator device are fixed to and a covering case that is fixed to said supporting frame, encloses said supporting frame and defines an inner cavity arranged to contain said actuator device and said pliers in the releasing position, and wherein said covering case includes an opening that allows said first and second levers to come out from the inner cavity in the gripping position.

6. The gripping apparatus according to claim 1, further comprising a diverting element fixed to one of said first and second jaws of said pliers and to said supporting arrangement, said diverting element being arranged to prevent the film from sticking to said pliers, or wrapping around said pliers, or sticking to and wrapping around said pliers when said first and second levers are moved from the gripping position to the releasing position.

7. The gripping apparatus according to claim 6, wherein said diverting element comprises an elongate flexible element having a first end portion fixed to said first jaw and a second end portion elastically fixed to said supporting arrangement, said elongate flexible element preventing the end flap of the film from sticking to said first and second levers, or from wrapping around said first and second levers, or sticking to and wrapping around said first and second levers, or engaging with an opening of a covering case that encloses said supporting frame and defines an inner cavity arranged to contain said actuator device and said pliers in the releasing position.

8. The gripping apparatus according to claim 1, wherein said actuator device comprises a linear actuator configured to move said second lever and said first lever between the releasing position and the gripping position.

9. The gripping apparatus according to claim 1, wherein said actuator device comprises elastic arrangement fixed to said supporting arrangement and to said second connecting end and configured to move said second lever and said first lever between the gripping position and the releasing position.

10. A wrapping machine for wrapping a load with a film, the wrapping machine comprising:

a gripping apparatus of claim 1; and a support for supporting said gripping apparatus.

* * * * *